US006756729B1

(12) United States Patent
Na et al.

(10) Patent No.: US 6,756,729 B1
(45) Date of Patent: Jun. 29, 2004

(54) FLAT PANEL DISPLAY AND METHOD OF FABRICATING SAME

(75) Inventors: Yang-Woon Na, Suwon-si (KR); Jong-Hun You, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 401 days.

(21) Appl. No.: 09/648,191

(22) Filed: Aug. 23, 2000

(30) Foreign Application Priority Data

Aug. 23, 1999 (KR) ..... 1999-35034
Oct. 14, 1999 (KR) ..... 1999-44602
Jan. 3, 2000 (KR) ..... 2000-80

(51) Int. Cl.[7] ..... H01J 63/04
(52) U.S. Cl. ..... 313/496; 313/302
(58) Field of Search ..... 313/495–497, 313/422, 292, 238, 288, 289, 310, 302, 307, 461; 345/75.2; 445/24, 25

(56) References Cited

U.S. PATENT DOCUMENTS 5,650,690 A 7/1997 Haven ..... 313/422
5,667,418 A * 9/1997 Fahlen et al. ..... 313/495
6,359,383 B1 * 3/2002 Chuang et al. ..... 313/496

* cited by examiner

*Primary Examiner*—Vip Patel
*Assistant Examiner*—Glenn Zimmerman
(74) *Attorney, Agent, or Firm*—Christie, Parker & Hale LLP

(57) ABSTRACT

A flat panel display includes a faceplate, a backplate combined with the faceplate to form a vacuum fight cell, and a light emission unit placed within the cell to emit light from the cell. The backplate has a plurality of electron emission sources. A frame is mounted on the backplate with opening portions. The electron emission sources are exposed through the opening portions of the frame toward the faceplate. A plurality of spacers are formed on the frame such that the spacers are positioned at a non-display area within the cell. A plurality of gate electrodes are formed at a surface of the frame with a predetermined pattern. The gate electrodes has opening portions communicating with the opening portions of the frame.

14 Claims, 16 Drawing Sheets

FLAT PANEL DISPLAY AND METHOD OF FABRICATING SAME

CROSS-REFERENCE TO RELATED APPLICATIONS

This Application claims priority to and the benefit of Korean Patent Application No. 1999-35034 filed on Aug. 23, 1999, Korean Patent Application No. 1999-44602 filed on Oct. 14, 1999, and Korean Patent Application No. 2000-80 filed on Jan. 3, 2000.

BACKGROUND OF THE INVENTION (a) Field of the Invention

The present invention relates to a flat panel display and a method of fabricating the same and, more particularly, to a flat panel display which has gate electrodes for making electrons to be emitted from electron emission sources, and a focusing electrode for controlling flow of the emitted electrons.

(b) Description of the Related Art

Generally, a flat panel display (FPD) has a faceplate, a backplate, and a side wall that are combined together to form a vacuum tight cell. The vacuum degree of the cell is established to be about $10^{-7}$ torr.

In case such a flat panel display, it is difficult to constantly maintain the cell gap due to the difference between the internal pressure and the external atmospheric pressure. For this reason, one or more spacers are provided within the cell to maintain the cell gap in a constant manner.

In the case of high voltage flat panel displays, the distance between the faceplate and the backplate reaches 1 mm or more. In this case, the electrons emitted from the electron sources do not land on the correct phosphors but strike the neighboring incorrect phosphors. In order to prevent such a mis-landing, the conventional high voltage flat panel display is provided with a focusing electrode for controlling flow of the emitted electrons.

In consideration of the above problems, U.S. Pat. No. 5,650,690 discloses a field emission display that has a gripper disposed on the faceplate, a locator disposed on the backplate, and a spacer wall interposed between the gripper and the locator to secure the internal space of the device in an effective manner. A focusing electrode surrounds emitters to control flow of the electrons emitted from the emitters.

In the above structure, the locator and the focusing electrode are formed through depositing a photoresist film onto a substrate based on spin coating or screen printing, and performing photolithography with respect to the photoresist film. In such a photolithography process, since thermal expansion coefficients of the electrode formation material and the plate formation material are different, their physical properties are liable to be deteriorated, and, after vacuum deposition, their moisture contents are slowly flown out while making damage to the minute emitters, decreasing the device life span. Furthermore, a high cost paste is deposited onto the plate by several tens micrometers to form electrodes, resulting in increased production cost.

SUMMARY OF THE INVENTION

It is an object of the present invention to provide a flat panel display which can be fabricated in a stable manner at an economic cost.

This and other objects may be achieved by a flat panel display including a faceplate, a backplate combined with the faceplate to form a vacuum tight cell, and a light emission unit placed within the cell to emit light from the cell. The backplate has a plurality of electron emission sources. A frame is mounted on the backplate with opening portions. The electron emission sources are exposed through the opening portions of the frame toward the faceplate. A plurality of spacers are formed on the frame such that the spacers are positioned at a non-display area within the cell. A plurality of gate electrodes are formed at a surface of the frame with a predetermined pattern. The gate electrodes has opening portions communicating with the opening portions of the frame.

According to one aspect of the present invention, a method of fabricating a flat panel display includes the steps of forming, a plurality of cathode electrodes on a first substrate, and forming emitters on the cathode electrodes as electron emission sources. A frame is then mounted onto the first substrate. The frame has opening portions corresponding to the emitters, a plurality of spacers positioned at a non-display area to maintain a cell gap, and a plurality of gate electrodes formed on a surface thereof. An anode electrode is formed on a second substrate. A plurality of phosphor layers are formed on the anode electrode. Finally, the first substrate is combined with the second substrate to thereby form a vacuum tight cell.

According to another aspect of the present invention, a method of fabricating a flat panel display includes the steps of forming a plurality of cathode electrodes on a first substrate, and forming emitters on the cathode electrodes as electron emission sources. A frame is then mounted onto the first substrate. The frame has opening portions corresponding to the emitters, a plurality of spacers positioned at a non-display area to maintain a cell gap, a plurality of gate electrodes formed on a surface thereof, and a focusing electrode formed on an opposite surface thereof. A plurality of anode electrodes are formed on a second substrate. A plurality of phosphors are formed on the anode electrodes. Finally, the first substrate is combined with the second substrate to thereby form a vacuum tight cell.

According to still another aspect of the present invention, in a method of fabricating a flat panel display, a plurality of cathode electrodes are formed on a first substrate with a predetermined pattern. Thereafter, a photosensitive dielectric layer is formed on the first substrate through screen-printing a photosensitive dielectric paste onto the entire surface of the first substrate, and drying the paste. The portions of the photosensitive dielectric layer corresponding to a pixel area are removed through partially exposing the photosensitive dielectric layer to light, and developing the light-exposed dielectric layer. Electron emission sources are formed at the removed portions of the dielectric layer. A plurality of opening portions are formed at a frame. The frame is formed with a photosensitive glass. A plurality of gate electrodes are formed on a surface of the frame. A plurality of spacers are formed on the frame at a non-display area. An anode electrode is formed on a second substrate. A plurality of phosphor layers are formed on the anode electrode. Finally, the frame is mounted onto the first substrate such that the electron emission sources are placed within the opening portions of the frame, and the second substrate is combined with the first substrate to thereby form a vacuum tight cell.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 1:
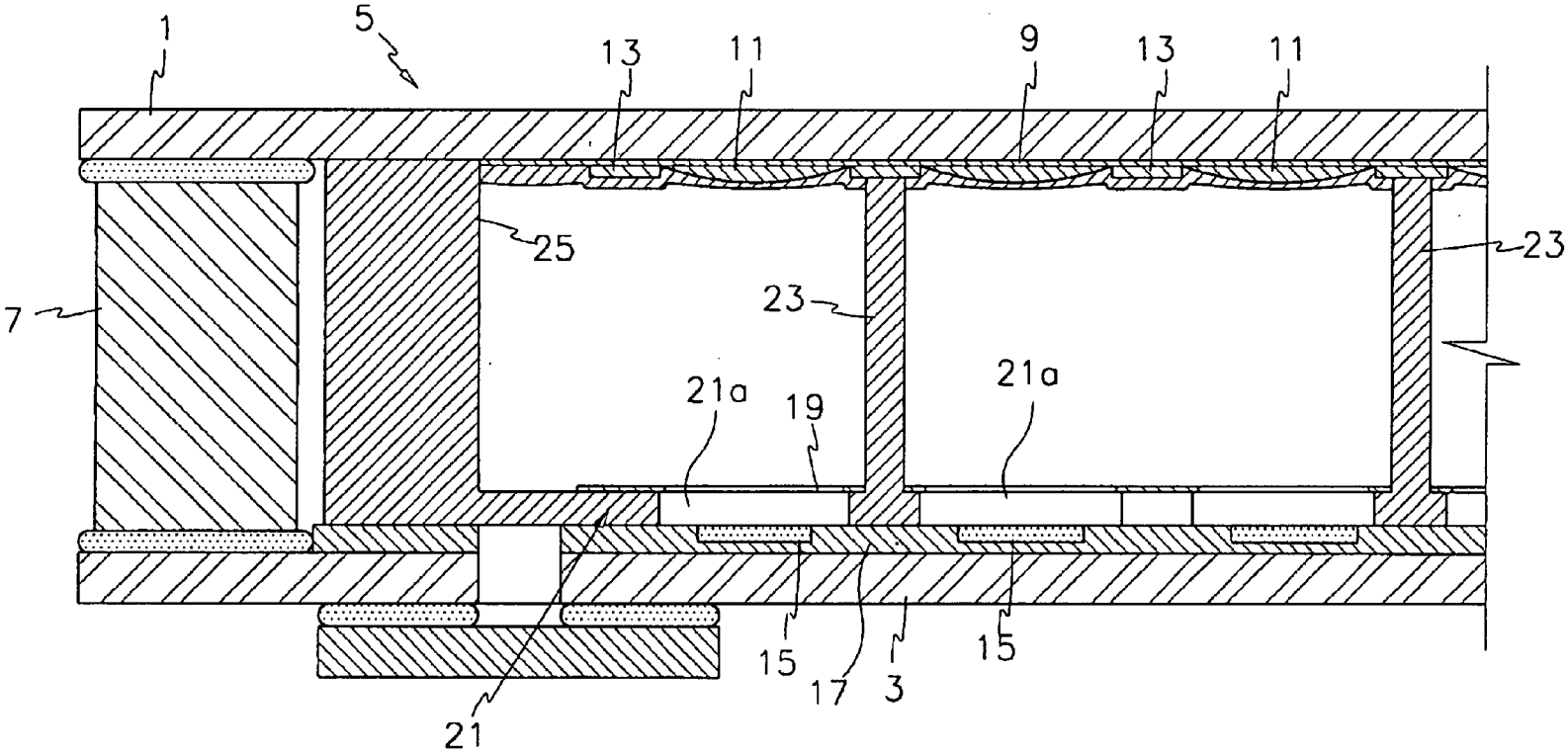
FIG. 1 is a cross sectional view of a flat panel display with a frame according to a first preferred embodiment of the present invention.

FIG. 1 is a cross sectional view of a flat panel display according to a first preferred embodiment of the present invention where a field emission display (FED) is exemplified as the flat panel display.

As shown in FIG. 1, the field emission display includes a faceplate 1, and a backplate 3 spaced apart from the faceplate 1 with a predetermined distance while proceeding parallel thereto. The faceplate 1 is combined with the backplate 3 to thereby form a vacuum fight cell 5. In the formation of the cell 5, a side glass 7 is interposed between the faceplate 1 and the backplate 3.

The faceplate 1 is sequentially overlaid with anode electrodes 9 with a predetermined pattern (ex. stripe), and a plurality of R, G and B phosphors 11. The phosphors 11 are formed on the anode electrodes 9 through slurry coating or screen printing. A black matrix 13 surrounds the phosphors 11.

In contrast, the backplate 3 is sequentially overlaid with cathode electrodes 17 with a predetermined pattern (ex. stripe), and a plurality of face emitters 15 that function as the electron source for striking the phosphors 11. It is preferable that the emitters 15 are formed with carbon nano-tubes.

A frame 21 is mounted at the backplate 3, and gate electrodes 19 are formed on the frame 21 to make electrons to be extracted from the emitters 15.

Figure 2:
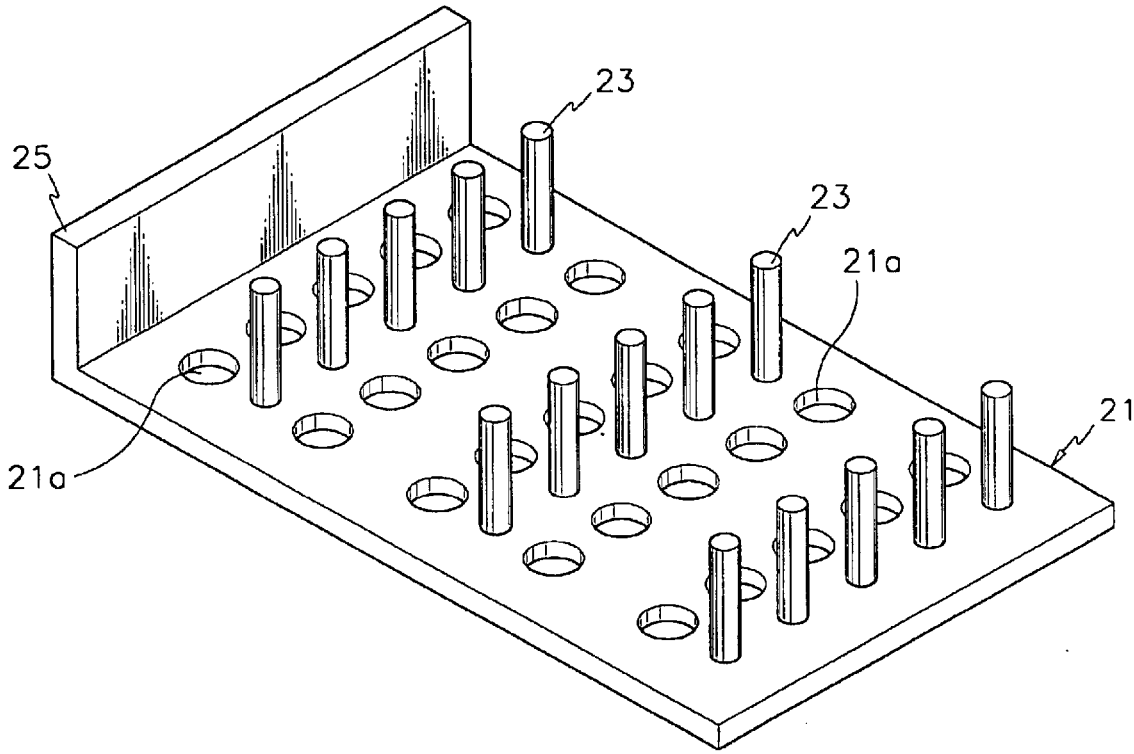
FIG. 2 is a perspective view of a frame for the flat panel display shown in FIG. 1.
Figure 3:
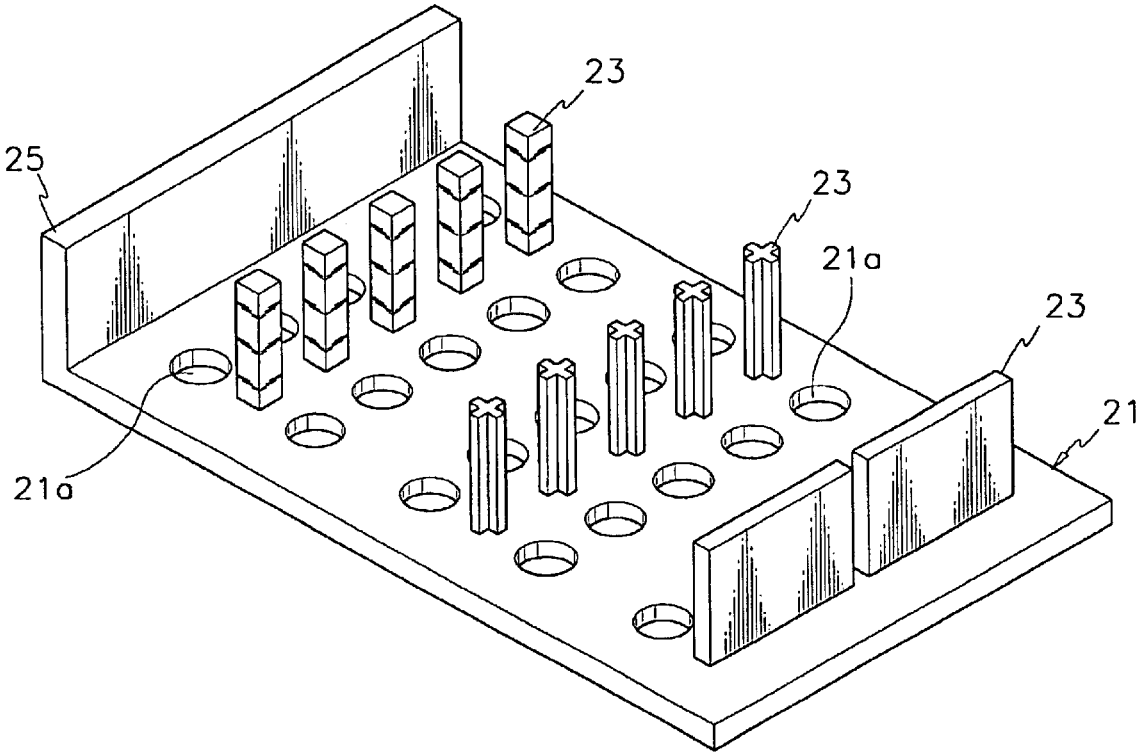
FIG. 3 is a perspective view of spacers for the flat panel display shown in FIG. 1.
Figure 4:
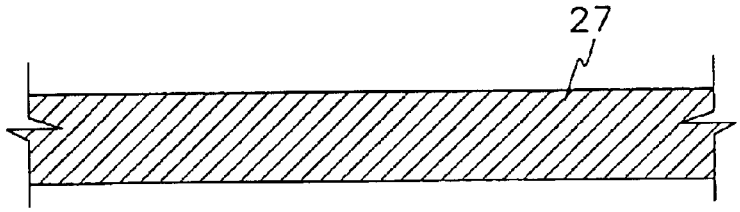
FIGS. 4 to 9 are schematic views illustrating the steps of processing a frame for the flat panel display shown in FIG. 1.
Figure 5:
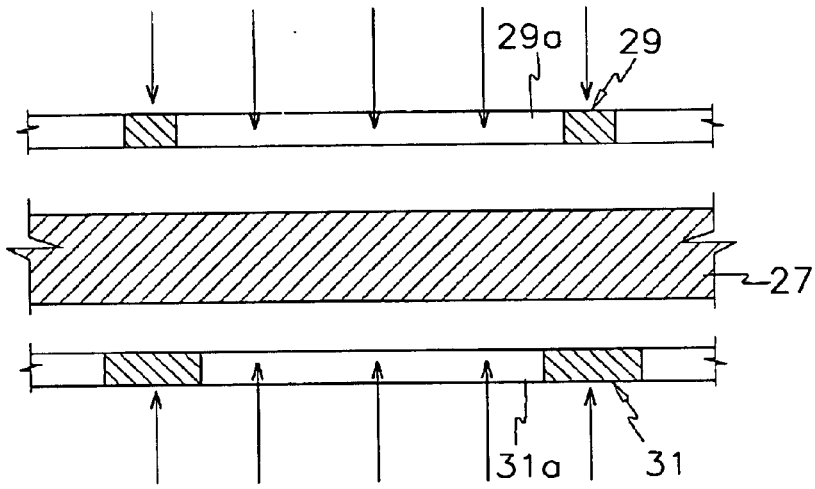
Figure 6:
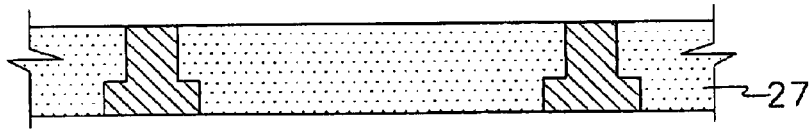
Figure 7:
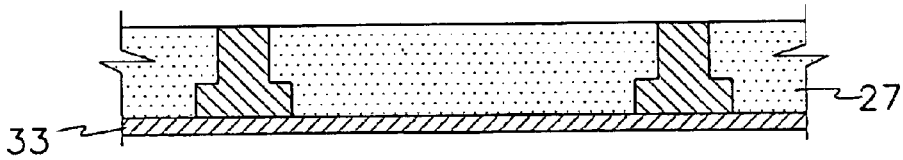
Figure 8:
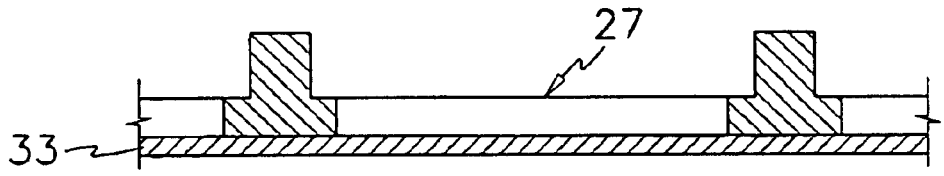

As shown in FIG. 2, the frame 21 has a size corresponding that of the backplate 3, and internally has a plurality of opening portions 21*a*. The opening portions 21*a* of the frame 21 are formed such that they correspond to the pixels of the phosphors 11 and the emitters 15. The frame 21 further has spacers 23 for maintaining the cell gap in a constant manner.

The spacers 23 are formed at the non-display area integral to the frame 21. The spacers 23 may be formed with a shape of a cylinder, a polyhedron with a section of rectangle or cross, or a thin sheet.

Furthermore, a support 25 placed at the same plane as the spacers 23 is integrally formed at a side portion of the frame 21 to maintain the cell gap together with the spacers 23.

In the meantime, the frame 21 is formed with a photosensitive glass through suffering separate processing steps. FIGS. 4 to 9 illustrate the steps of processing the frame 21 while focusing at one of the opening portions 21*a* formed at the frame 21 for convenience in illustration.

As shown in the drawing, a photosensitive glass 27 with a predetermined thickness is exposed to light through masks 29 and 31 for about 30 minutes. The masks 29 and 31 has opening portions 29*a* and 31*a*, respectively. Then, the light-exposed glass 27 is moved into a furnace (not shown), and suffers two stepped heat-treatments at 500° C. for one hour, and at 600° C. for one hour. Thereafter, an over-etching prevention layer 33 is formed on an one-sided surface of the glass 27 as a photoresist. The over-etching prevention layer 33 is to prevent the surface of the glass 27 from being over-etched in the subsequent etching step.

Figure 9:
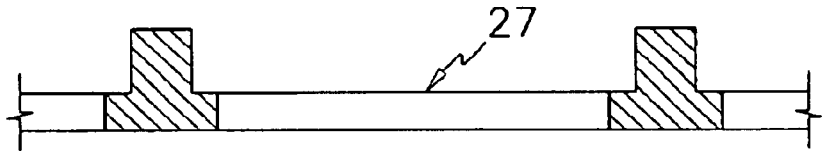

In the etching step, the glass 27 is dipped into an etching solution of HF 10% for 10–40 minutes. As a result, heat-treated portions are removed from the glass 27, and the glass 27 has a shape shown in FIG. 8. Finally, as shown in FIG. 9, the over-etching prevention layer 33 is removed from the glass 27 to complete a frame 21 with spacers 23.

Figure 10:
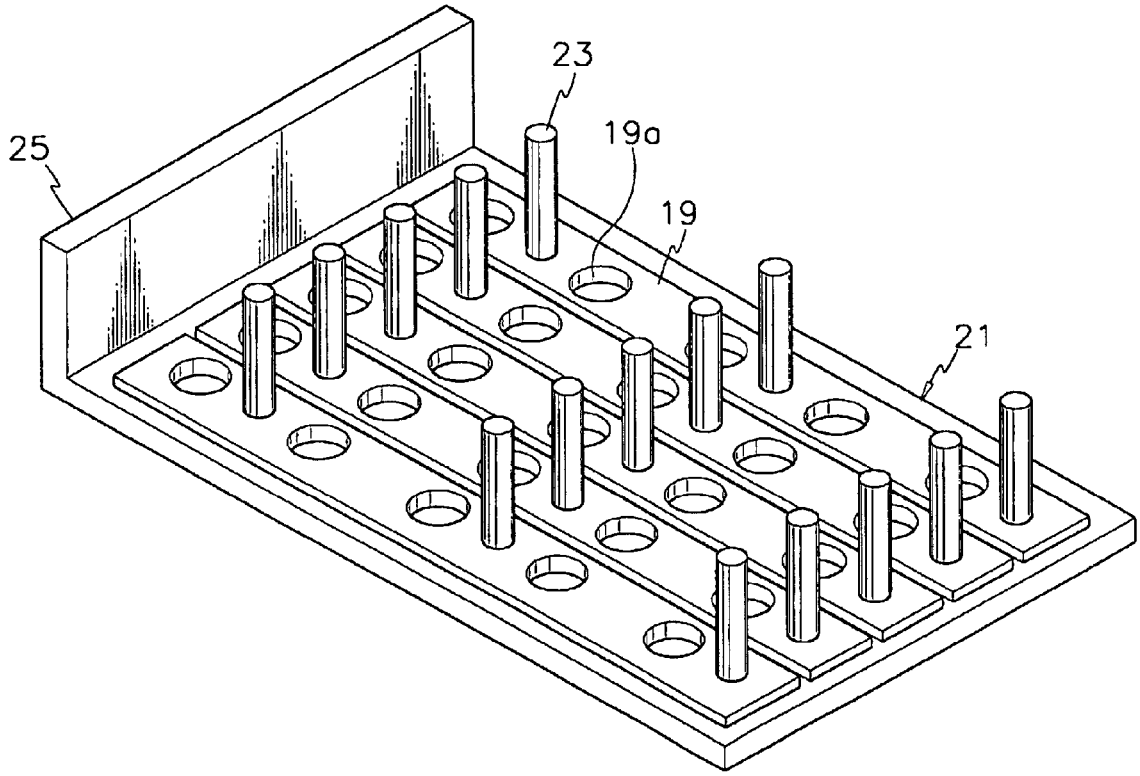
FIG. 10 is a perspective view of gate electrodes arranged on a frame for the flat panel display shown in FIG. 1.

As shown in FIG. 10, the gate electrodes 19 are formed on the frame 21 with a predetermined thickness and a stripe pattern. The gate electrodes 19 have opening portions 19*a* corresponding to the opening portions 21*a* of the frame 21. The gate electrodes 19 are preferably formed through vapor deposition based on aluminum (Al) or indium tin oxide (ITO).

Figure 11:
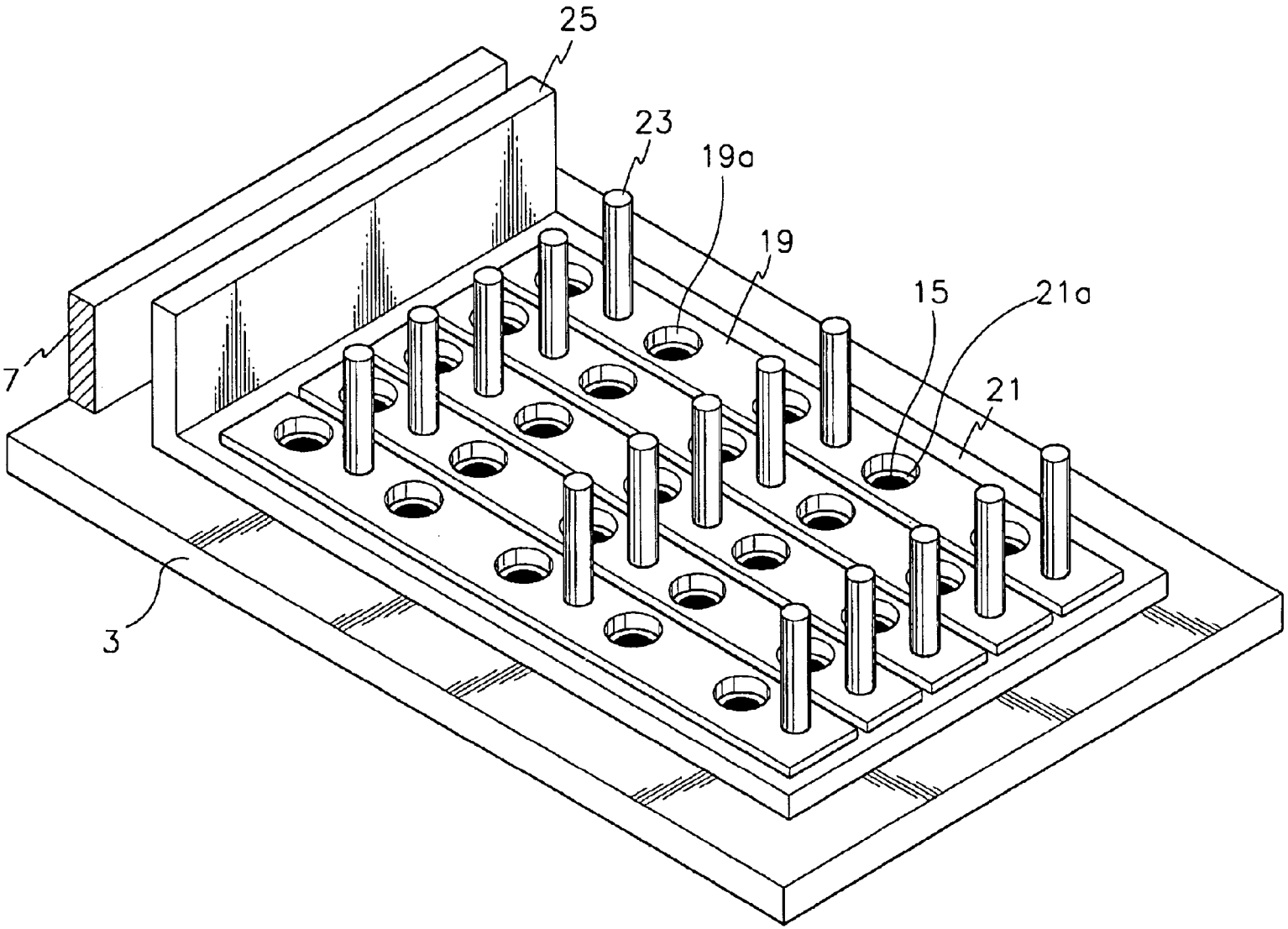
FIG. 11 is a perspective view of a frame mounted on a backplate for the flat panel display shown in FIG. 1.

FIG. 11 is a perspective view of the frame 21 mounted on the backplate 3. As shown in FIG. 11, the frame 21 is mounted onto the backplate 3 such that the emitters 15 are arranged within the opening portions 21*a* thereof. Of course, the spacers 23 are naturally placed at the non-display region within the cell 5. That is, the position control of the plurality of spacers 23 can be performed simultaneously with the mount of the frame 21 onto the backplate 3.

Figure 12:
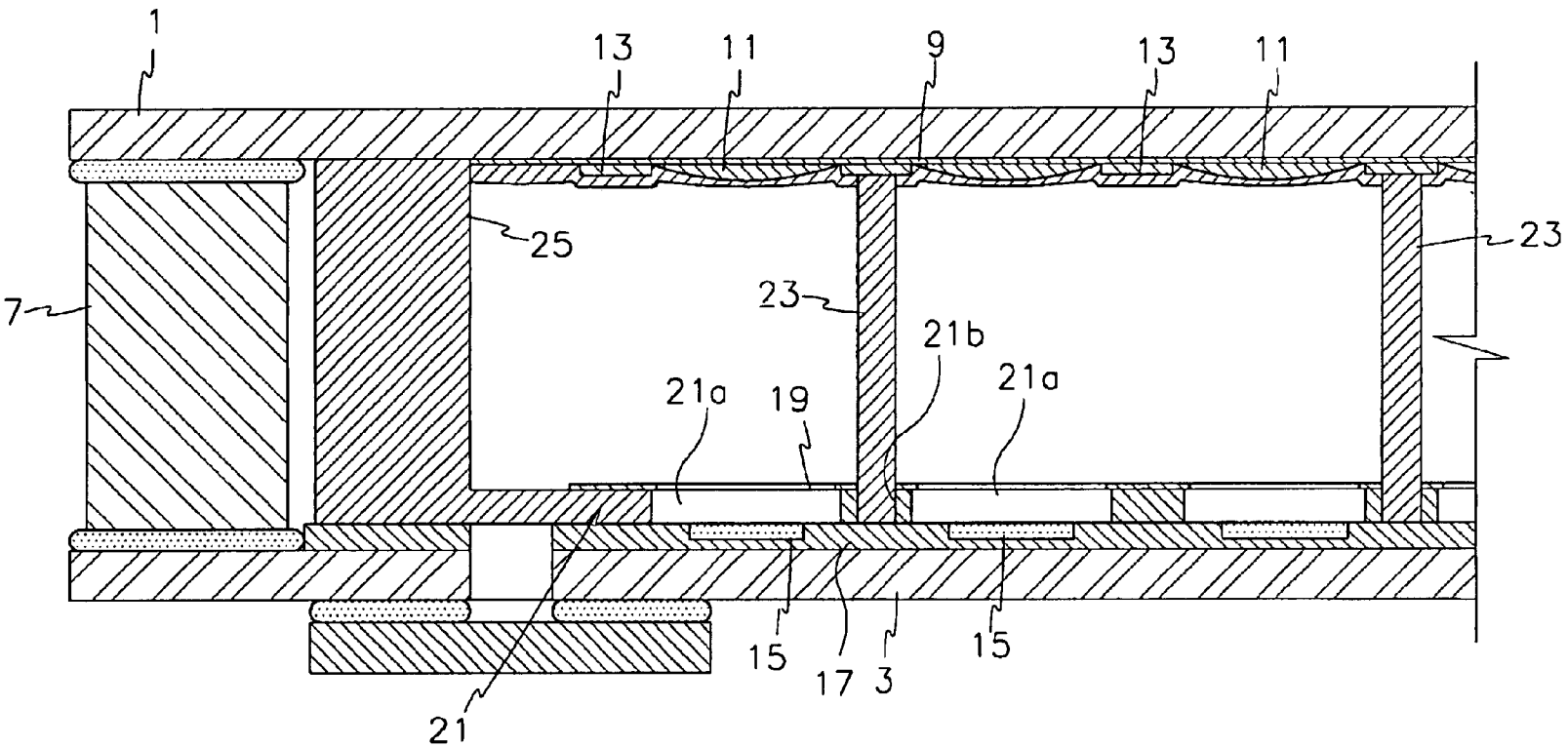
FIG. 12 is a cross sectional view of a flat panel display according to a second preferred embodiment of the present invention.

FIG. 12 is a cross sectional view of a field emission display according to a second preferred embodiment of the present invention. In this preferred embodiment, other components and structures of the field emission display are the same as those related to the first preferred embodiment except that the spacer fixation structure formed at the frame is differentiated. That is, in the previous preferred embodiment, the spacers are integrally formed at the frame, whereas, in this preferred embodiment, the spacers 23 are not formed with the frame 21 in a body, but fixed to the frame 21 by way of fixation holders 21*b*.

The spacer fixation holders 21*b* are breakthrough holes formed at the frame 21. The spacers 23 are made separately from the frame 21, and one-sided end portions of the spacers 23 are fitted within the holders 21*b*. Of course, as described above, the spacers 23 may be formed with various shapes such as a cylinder. The holder 21*b* may have a shape corresponding to the shape of the spacer 23. For example, when the spacer is shaped with a cylinder, the holder 21*b* may be formed with a circular opening portion. When the spacer 23 is shaped with a section of rectangle, the holder 21*b* may be formed with a rectangular opening portion.

As the spacers 23 are not formed with the frame 21 in a body, in the formation process of the frame 21, a mask for exposing the photosensitive glass to light is provided only at one-sided surface of the photosensitive glass, and the over-etching prevention layer is not required. Of course, other processing steps for forming the frame 21 are performed in the same way as that related to the first preferred embodiment.

Like the above, in the structure of the field emission display according to the second preferred embodiment, separate spacers 23 are fixed to the frame 21, and the frame 21 with the spacers 23 is mounted onto the backplate 3. In this way, the processing steps can be simplified while accompanying with other advantageous effects.

Figure 13:
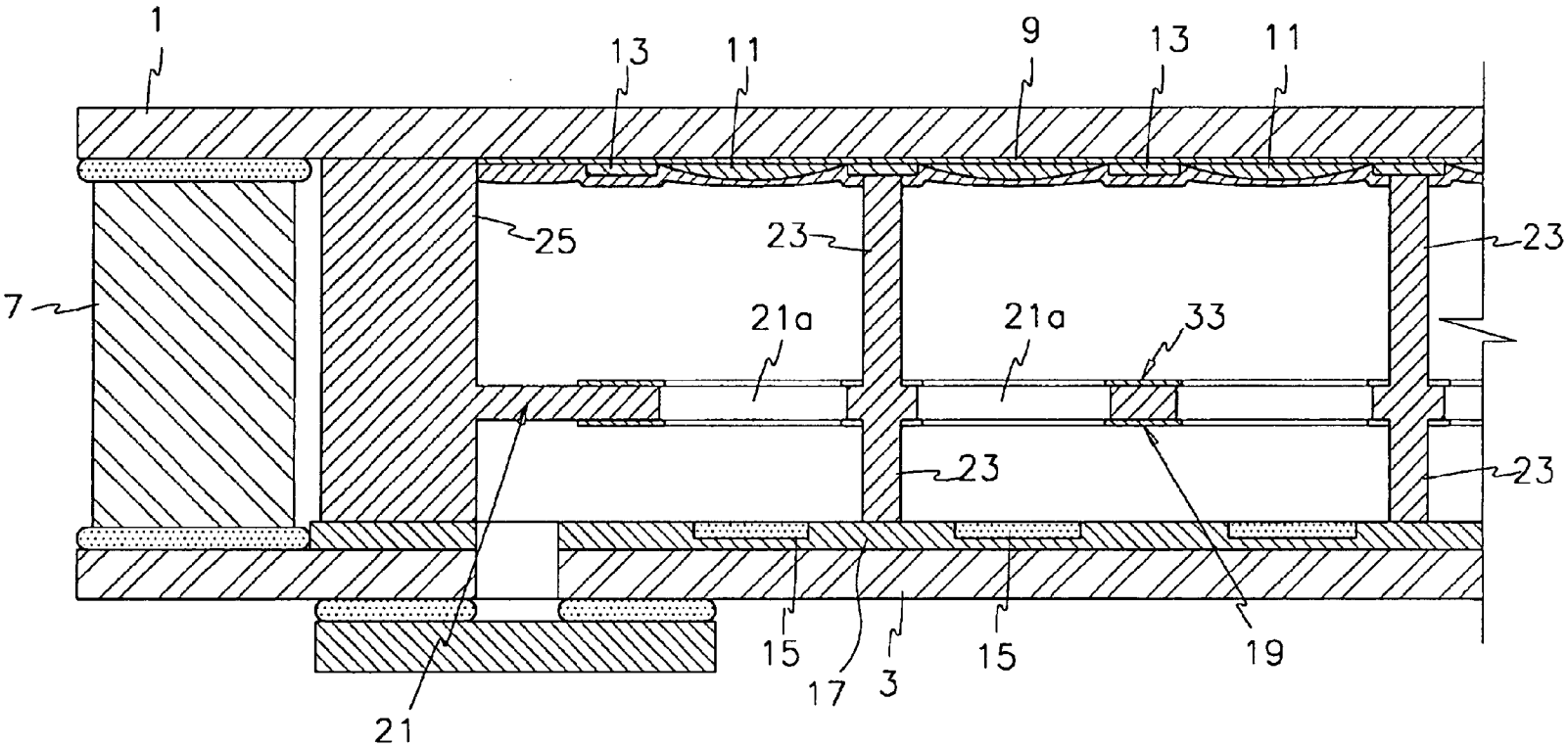
FIG. 13 is a cross sectional view of a flat panel display according to a third preferred embodiment of the present invention.

FIG. 13 is a cross sectional view of a field emission display according to a third preferred embodiment of the present invention. In this preferred embodiment, a photosensitive glass-based frame 21 is also provided between the faceplate 1 and the backplate 3. In addition to the gate electrodes 19, a focusing electrode 33 is formed on the frame 21 to control flow of electrons extracted from emitters 15.

Specifically, the frame 21 has a size corresponding to that of the backplate 3, and is internally formed with a plurality of opening portions 21*a*, and spacers 23 for maintaining the cell gap in a constant manner.

Figure 14:
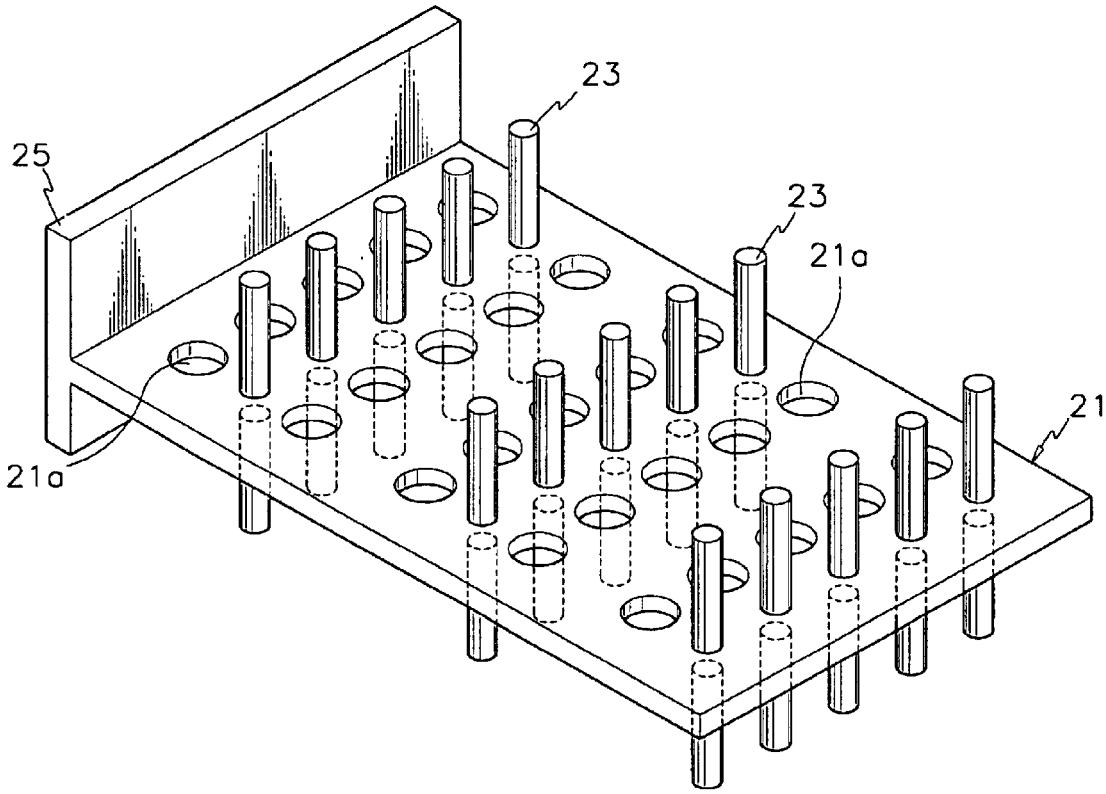
FIG. 14 is a perspective view of the flat panel display shown in FIG. 13.

As shown in FIG. 14, the spacers 23 are integrally formed at both upper and lower surfaces of the frame 21 such that they are positioned at the non-display area within the cell. As previously described, the spacers 23 may be shaped with a cylinder, a polyhedron having a section of rectangle or cross, or a thin sheet.

As the spacers 23 are formed at both upper and lower surfaces of the frame 21, the formation process thereof does not include the step of forming an over-etching prevention layer while other processing steps being the same as those related to the first preferred embodiment.

Figure 15:
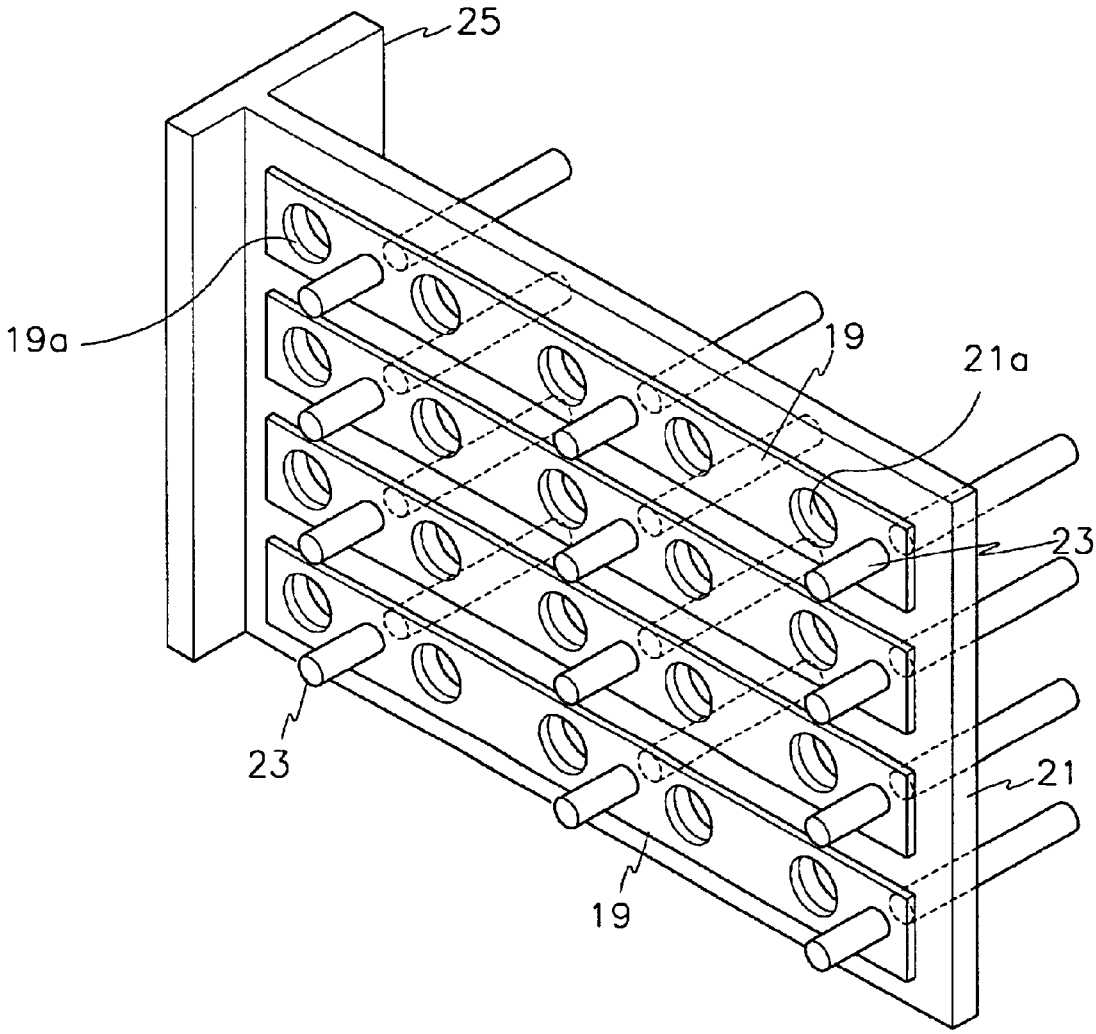
FIG. 15 is a perspective view of gate electrodes arranged on a frame for the flat panel display shown in FIG. 13.
Figure 16:
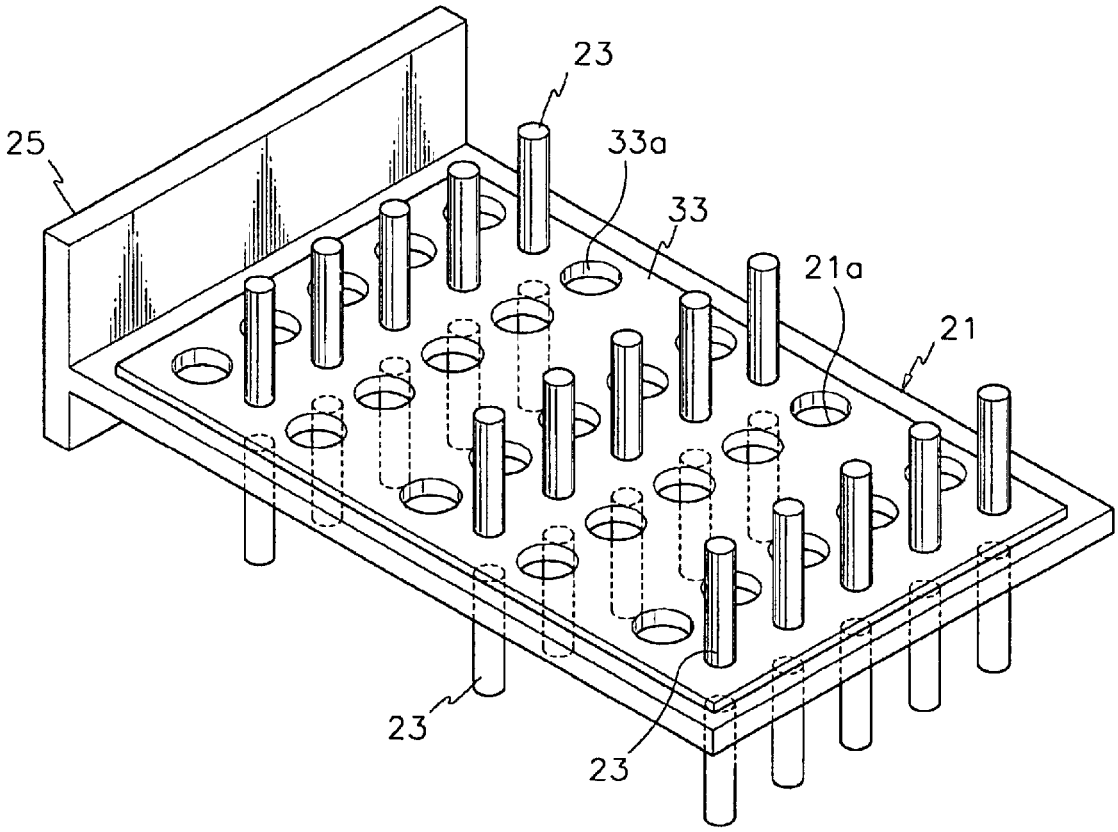
FIG. 16 is a perspective view of a focusing electrode formed on a frame for the flat panel display shown in FIG. 13.

As shown in FIG. 15, the gate electrodes 19 are formed on the one-sided surface of the frame 21 (facing the backplate 3) with a stripe pattern, and, as shown in FIG. 16, the focusing electrode 33 is entirely formed on the opposite surface of the frame 21 (facing the anode electrode 9) with a predetermined thickness. Of course, the gate electrodes 19, and the focusing electrode 33 are provided with opening portions 19*a* and 33*a* corresponding to the opening portions 21*a* of the frame 21.

The gate electrodes 19 and the focusing electrode 33 are preferably formed through vapor deposition based on aluminum or indium tin oxide. In this preferred embodiment, the gate and focusing electrodes 19 and 33 are formed with different materials.

Figure 17:
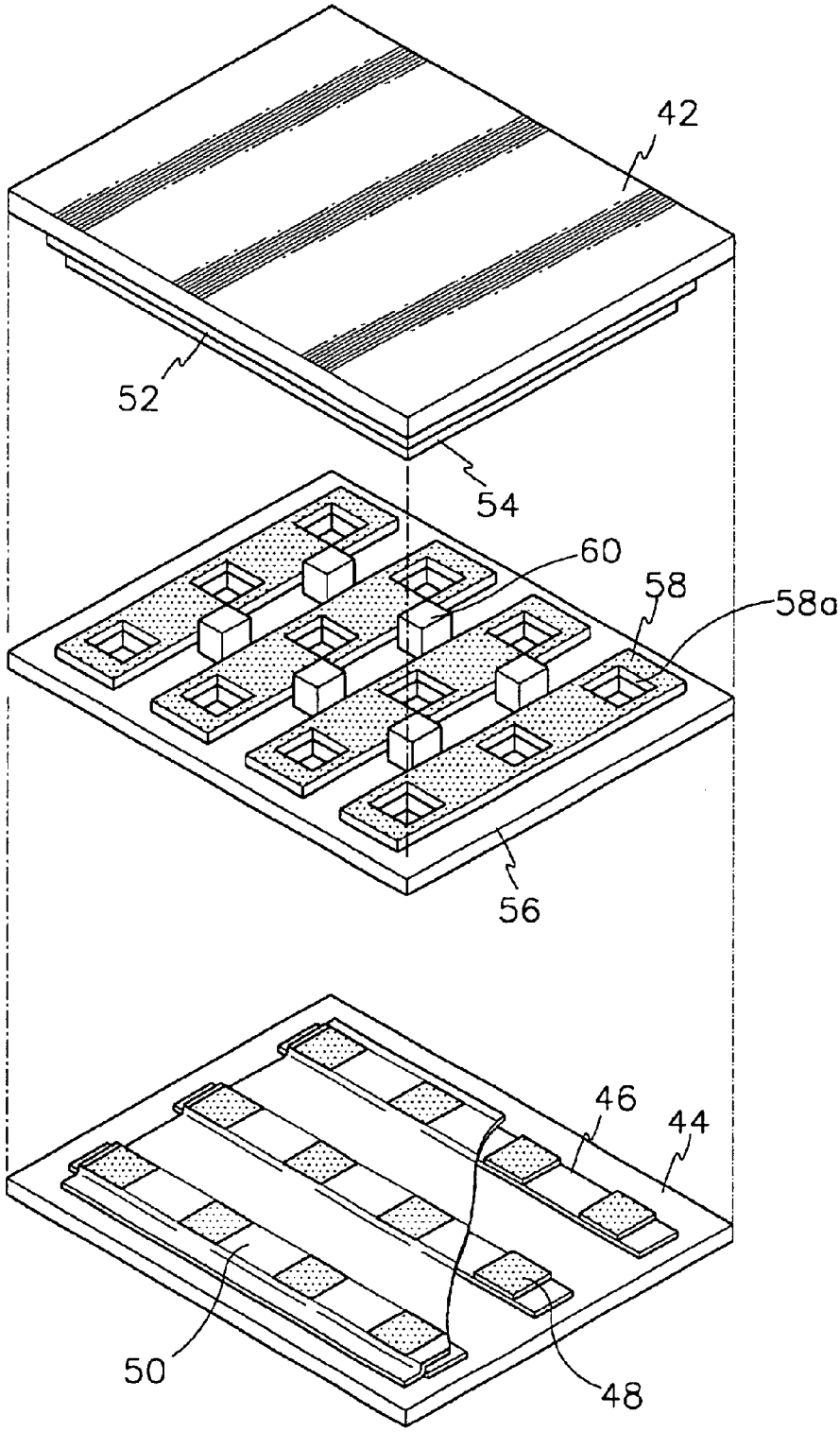
FIG. 17 is an exploded perspective view of a flat panel display according to a fourth preferred embodiment of the present invention.
Figure 18:
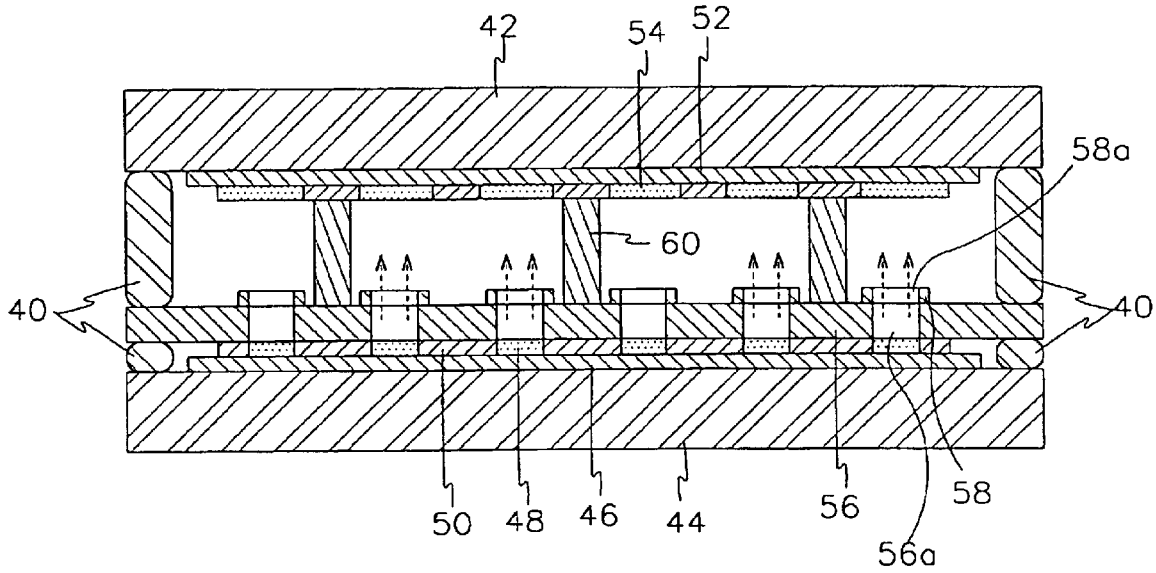
FIG. 18 is a combinatorial sectional view of the flat panel display shown in FIG. 17.

FIG. 17 is an exploded perspective view of a field emission display according to a fourth preferred embodiment, and FIG. 18 is a combinatorial sectional view of the field emission display shown in FIG. 17.

As shown in the drawings, the field emission display includes a faceplate 42 and a backplate 44 that are combined with each other via a frit 40.

A plurality of cathode electrodes 46 are formed on the backplate 44 with a stripe pattern, and carbon nano-tubes 48 are separately formed on the cathode electrodes 46 as field emitters while being spaced apart from each other with a predetermined distance.

Furthermore, a dielectric layer 50 based on a photosensitive material is formed on the backplate 44 except the portions where the carbon nano-tubes 48 are placed.

In contrast, an anode electrode 52 is formed on the faceplate 42 with a predetermined pattern, and a plurality of phosphors 54 are formed on the anode electrode 52.

A frame 56 based on a photosensitive glass is provided between the plates 42 and 44, and the plates 42 and 44 are combined with each other via a frit 40. The frame 56 has opening portions 56*a* corresponding to the carbon nano-tubes 48, and gate electrodes 58 are formed on the one-sided surface of the frame 56 (facing the faceplate 42) to make electrons to be extracted from the carbon nano-tubes 48.

The gate electrodes 58 have opening portions 58a communicating with the opening portions 56*a* of the frame 56. The gate electrodes 58 proceed perpendicular to the cathode electrodes 46.

Furthermore, in order to maintain the cell gap in a constant manner, a plurality of spacers 60 are arranged at the non-display area while being interposed between the plates 42 and 44.

In this preferred embodiment, the process of fabricating the field emission display are performed in the following way.

Roughly, relevant components are first formed at the backplate 44 and the faceplate 42, respectively. Then, the gate electrodes 58 are formed at the frame 56. Finally, the faceplate 42, the backplate 44, and the frame 56 are combined together.

Figure 19:
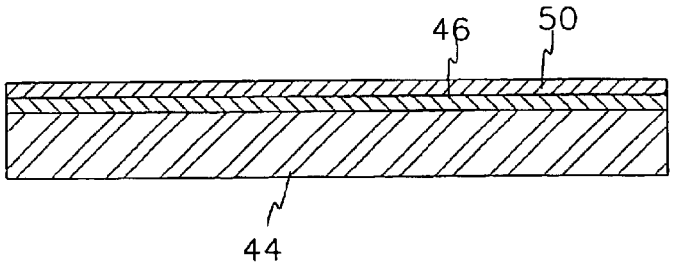
FIGS. 19 to 21 illustrate the steps of forming a dielectric layer for the flat panel display shown in FIG. 17.

Specifically, as shown in FIG. 19, silver paste is screen-printed onto the backplate 44 in a stripe pattern, and heat-treated to thereby form cathode electrodes 46. Positive photosensitive dielectric paste is screen-printed onto the cathode electrodes 46, and dried to thereby form a dielectric layer 50.

Figure 20:
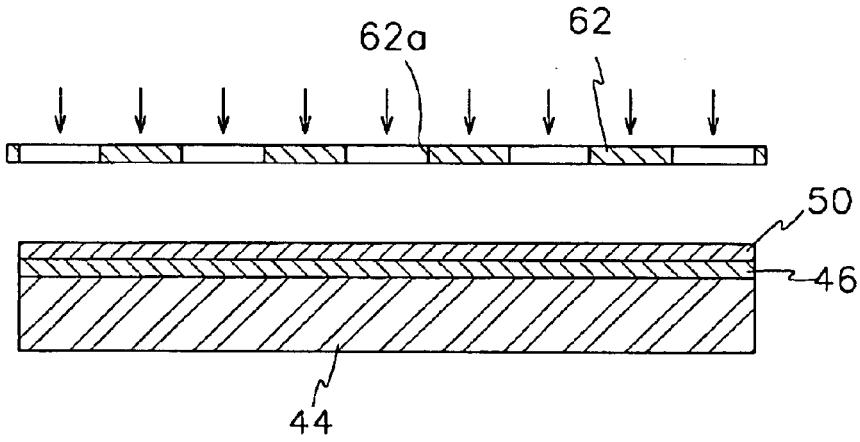
Figure 21:
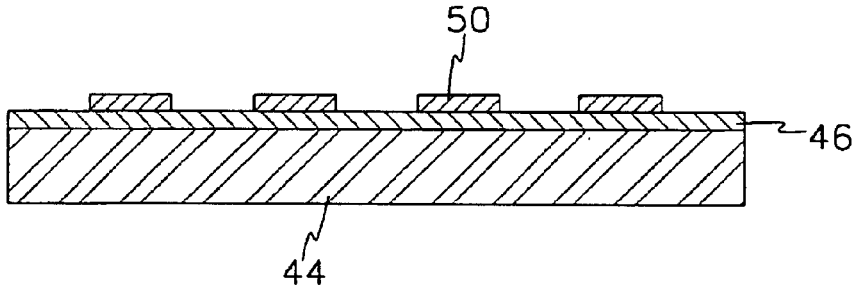

Thereafter, as shown in FIG. 20, a mask 62 with a plurality of light exposing holes 62*a* corresponding to the pixel area is mounted over the dielectric layer 50, and the dielectric layer 50 is exposed to light for a predetermined time so that the light exposed portions thereof bear increased solubility. Then, as shown in FIG. 21, the dielectric layer 50 is developed, and the light exposed portions thereof bearing increased solubility are removed from the dielectric layer 50 to thereby form opening patterns.

The opening patterns of the dielectric layer 50 are to receive carbon nano-tubes 48.

Figure 22:
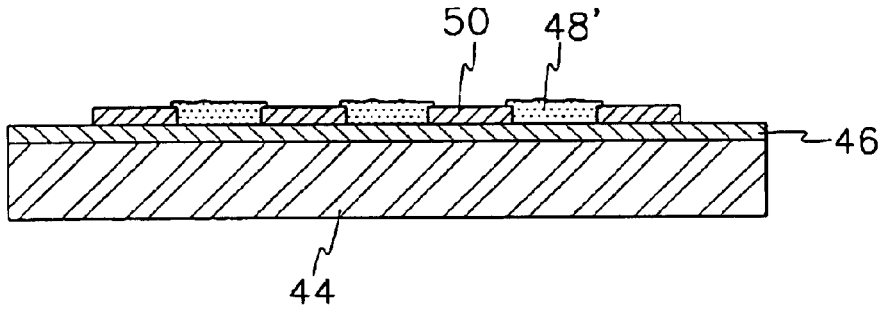
FIGS. 22 and 23 illustrate the steps of forming electron emission sources for the flat panel display shown in FIG. 17.

In order to form such carbon nano-tubes 48, as shown in FIG. 22, a carbon nano-tube paste 48' is first screen-printed at the opening patterns of the dielectric layer 50. Thereafter, the backplate 44 is baked at 450–500 under the atmospheric pressure such that the binder content is evaporated from the paste 48'.

Figure 23:
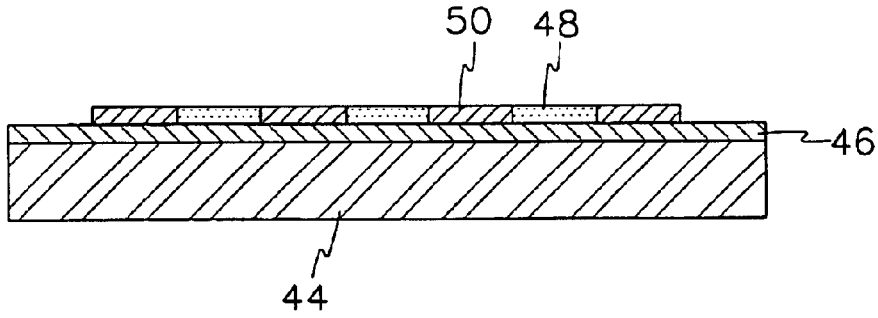

As shown in FIG. 23, the carbon nano-tubes 48 are surface-treated through grinding to obtain uniform surfaces.

Meanwhile, the frame 56 is formed with a photosensitive glass, and passes through the steps of light exposing, heattreating, and etching to form a plurality of opening portions 56*a*. The gate electrodes 58 are formed through screen-printing metallic silver paste onto a surface of the frame 56 with a stripe pattern, and drying and baking the paste.

After the gate electrodes 58 are formed on the frame 56, a plurality of spacers 60 are formed on the frame 56 at the non-display area.

By contrast, the formation process of the anode electrode 52 and the phosphors 54 at the faceplate 42 is made in the conventional way.

Finally, the frame 56 is mounted onto the backplate 44 such that the carbon nano-tubes 48 are exposed through the opening portions 56*a* thereof, and fixed to the backplate 44. Then, the faceplate 42 is mounted onto the frame 56, and fixed to the frame 56 to thereby complete a field emission display.

As described above, in the inventive flat panel display, the gate electrodes, the focusing electrode and the spacers are formed at the backplate not in a direct manner but via a separate frame, the problems of damage to the products and high production cost involved in the prior art-based flat panel displays can be effectively solved.

Furthermore, the above-described structure related to the field emission display may be applied to other flat panel displays such as flat CRTs.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A flat panel display comprising:

a faceplate;

a backplate combined with the faceplate to form a vacuum tight cell, the backplate having a plurality of electron emission sources;

a light emission unit placed within the cell to emit light from the cell;

a frame mounted on the backplate, the frame having a support portion maintaining a cell gap between the faceplate and the backplate and an integral support extension extending from the support portion, the integral support extension having opening portions, the electron emission sources being exposed through the opening portions toward the faceplate;

a plurality of spacers formed on the integral support extension such that the spacers are positioned at a non-display area within the cell; and a plurality of gate electrodes formed at a surface of the integral support extension with a predetermined pattern, the gate electrodes having opening portions communicating with the opening portions of the frame.

2. The flat panel display of claim 1 wherein the frame is formed with a photosensitive glass.

3. The flat panel display of claim 1 further comprising a focusing electrode formed on an opposite surface of the integral support extension with a predetermined pattern, the focusing electrode having opening portions communicating with the opening portions of the frame.

4. The flat panel display of claim 1 wherein the light emission unit comprises:

a plurality of cathode electrodes formed on the backplate within the cell;

emitters formed on the cathode electrodes as the electron emission sources while being placed within the opening portions of the frame;

anode electrodes formed on the faceplate within the cell with a predetermined pattern; and a plurality of phosphors formed on the anode electrode.

5. The flat panel display of claim 4 wherein the emitters are face-emitters.

6. The flat panel display of claim 5 wherein the emitters are formed with carbon nano-tubes.

7. The flat panel display of claim 1 wherein the spacers are formed on a one-sided surface of the integral support extension.

8. The flat panel display of claim 1 wherein the spacers are formed on both surfaces of the integral support extension opposite to each other.

9. The flat panel display of claim 1 wherein the spacers and the frame are integrally formed in a body with the same material.

10. The flat panel display of claim 7 wherein the integral support extension has holders, and the spacers are fitted within the holders.

11. The flat panel display of claim 1 wherein the support portion is formed at a side of the frame such that the support portion fixedly contacts the faceplate.

12. The flat panel display of claim 1 wherein the support portion is formed at a side of the frame such that the side portion is fitted between the faceplate and the backplate.

13. The flat panel display of claim 4 further comprising a dielectric layer formed on the backplate except the portions where the emitters are placed.

14. The flat panel display of claim 13 wherein the dielectric layer is formed with a photosensitive material.

* * * * *